United States Patent [19]

Levesque

[11] 3,950,218

[45] Apr. 13, 1976

[54] METHOD OF MANUFACTURING STABILIZED FLUFFY BATTS OF FIBERS AND RESULTING PRODUCT THEREFROM

[75] Inventor: Yvon George Levesque, Montreal, Canada

[73] Assignee: Johnson & Johnson, New Brunswick, N.J.

[22] Filed: Jan. 7, 1974

[21] Appl. No.: 431,280

[52] U.S. Cl. ..... 162/201; 162/183; 162/184; 264/121

[51] Int. Cl.[2] ..... D21H 3/00

[58] Field of Search ..... 162/9, 100, 182, 183, 184, 162/181 A, 201, 169, 157 C, 213, 158; 128/284, 287; 264/109, 116, 121, 123, 125, 126; 117/66, 120, 140 A; 427/209, 331, 439

[56] References Cited

UNITED STATES PATENTS

| | | | |
|---|---|---|---|
| 2,599,094 | 6/1952 | Craig | 162/181 A |
| 2,744,045 | 5/1956 | Collins | 264/121 |
| 2,913,356 | 11/1959 | Shroeder | 162/157 C |
| 3,083,118 | 3/1963 | Bridgeford | 162/157 C |
| 3,224,926 | 12/1965 | Bernardin | 162/158 |
| 3,440,135 | 4/1969 | Chung | 162/157 C |
| 3,632,391 | 1/1972 | Whitfield | 117/140 A |
| 3,677,886 | 7/1972 | Forssblad et al. | 162/182 |
| 3,756,913 | 9/1973 | Wodka | 162/100 |
| 3,812,006 | 5/1974 | Shortmann et al. | 162/158 |

OTHER PUBLICATIONS

Casey "Pulp & Paper" Vol. II, 2nd ed., (1960), p. 947.

*Primary Examiner*—S. Leon Bashore
*Assistant Examiner*—Peter Chin
*Attorney, Agent, or Firm*—Robert L. Minier

[57] ABSTRACT

A method of manufacturing stabilized, fluffy batts of individualized fibers by treating the surfaces of dense batts of fibers with materials which will react with each other on contact or which can be caused to react with each other by subsequent treatment. The treated dense batt is comminuted or ground to individualize fibers and the fibers collected in the form of a fluffy batt. The materials react with each other on contact or the fluffy batt may thereafter be teated to cause the materials to react. The resulting product is a lightweight, fluffy batt of individualized fibers having reacted materials uniformly distributed throughout the batt to provide the batt with the desired final properties, such as resiliency, absorbency and bulk in a stabilized state.

12 Claims, 5 Drawing Figures

Figure 1:
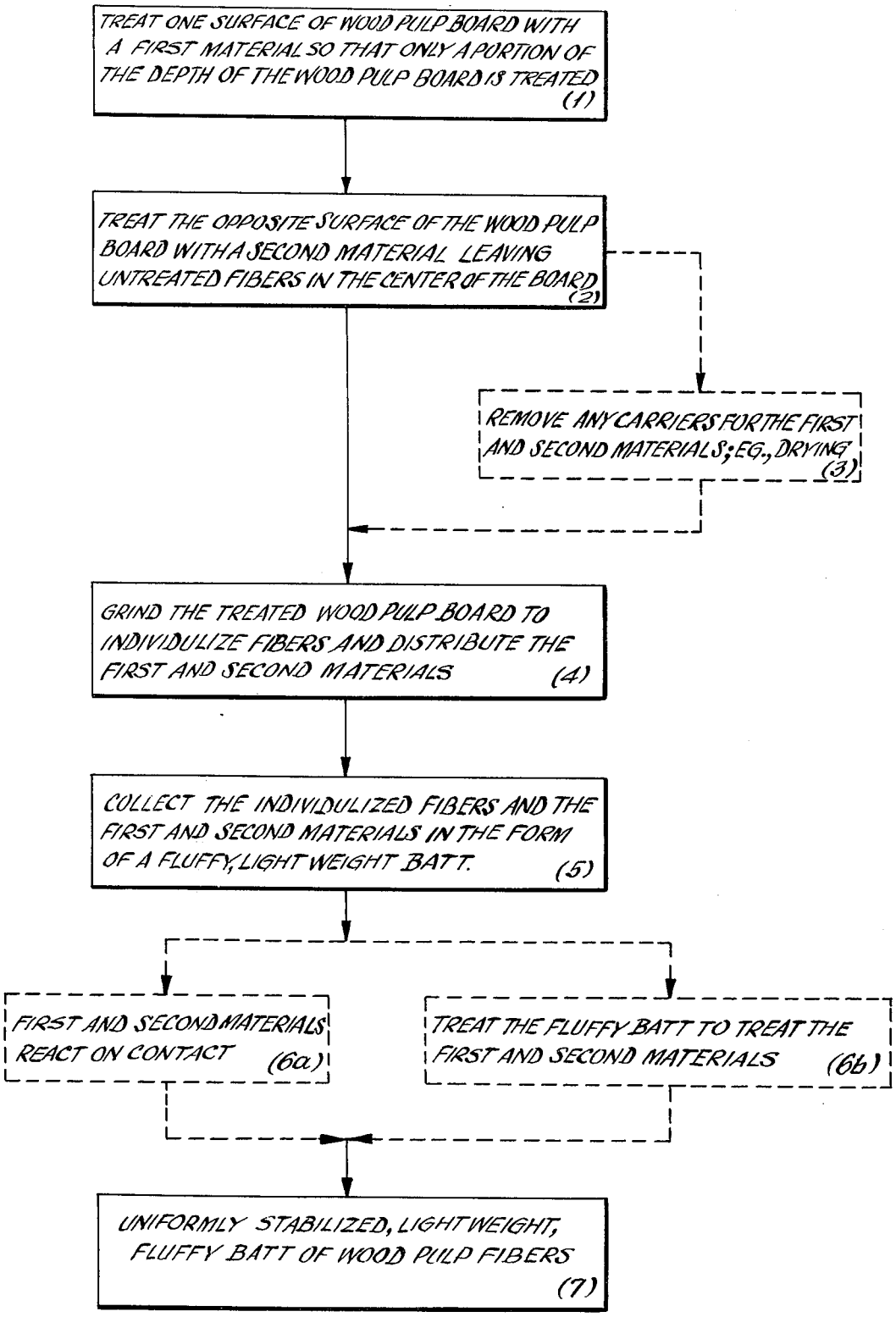

METHOD OF MANUFACTURING STABILIZED FLUFFY BATTS OF FIBERS AND RESULTING PRODUCT THEREFROM

The present invention relates to a method for manufacturing stabilized, lightweight batts of individualized fibers preferably wood pulp fibers which have uniformly distributed throughout the individualized wood pulp fibers binder or other stabilizing materials which provide desired properties in the final batt.

BACKGROUND OF INVENTION

For considerable time now absorbent batts have been made from fluffed wood pulp fibers. Such absorbent batts are used in sanitary napkins, disposable diapers, absorbent dressings and the like to produce a media which is highly absorbent and has considerable capacity for holding fluids. The individualized wood pulp fibers are used not only because of their desirable absorbent properties but also because of their softness and low cost. In many instances the batts are wrapped with tissue or nonwoven fabric or the like to prevent linting or dusting of the fibers during use although in certain products the surface of the batt may be stabilized by the addition of a binder to prevent this linting and remove the necessity of using a cover or a wrapping for the batt.

In manufacturing the absorbent, lightweight, fluffy, wood pulp batts a number of problems may be encountered depending on the properties desired in the final batt. For example, a technique for preventing the dusting or linting of fibers is to add a binder to the fibers to stabilize the batt and adhere fibers together. The binders are generally applied from aqueous or other liquid solutions and the addition of liquids to the fluffy batt greatly reduces the loft of the batt. Also, it is extremely difficult to apply the binder uniformly throughout the depth and over the area of the batt. Furthermore, it is very difficult if not impossible to apply certain combinations for reactive materials to the batt such that the reactant product is distributed uniformly. For example, inorganic, insoluble cements such as a calcium silicate made by reacting calcium chloride with sodium silicates cannot be used in these prior processes to stabilize the batt.

I have now discovered a process for manufacturing a highly absorbent, lightweight, fluffy batt of wood pulp fibers which is uniformly stabilized throughout the entire depth of the batt without detrimental effects on the other properties of the batt. My new process does not require the application of liquids or aqueous media to the fluffy batt and hence allows us to maintain the excellent loft of the fluffy batt. Furthermore, my new technique allows the addition of other types of fibers to the wood pulp fibers with relative ease and without detrimental effects on the physical properties of the batt. My new process provides uniform distribution of the stabilizing materials and eliminates problems of migration of these materials in that they are placed in position and stay in that position throughout the process and in the final batt. My new stabilized batts have excellent resiliency, absorbency and bulk and as will be seen from the description given hereinafter my new process has excellent advantages both in economics and in the simplicity of the process.

THE PRESENT INVENTION

I have now discovered a method of manufacturing fluffy lightweight batts of wood pulp fibers which have excellent loft and good resiliency without detrimental effect on either absorbent capacity or rate of absorbency of the batt.

My new method allows for simple economical production of the fluffy lightweight batts and allows for the production of stabilized batts of fluffed, wood pulp fibers wherein the linting or dusting of fibers is greatly reduced and may be substantially eliminated.

Furthermore, my new process is very flexible and allows the addition of other materials to provide desired properties in the final product whether these materials be in particulate form, fiber form or other form.

In accordance with the present invention wood pulp board is treated on a first surface with a first material and wood pulp board is treated on a second surface with a second material which will react with the first material. The two materials may react upon contact with each other or they may react by some subsequent treatment of the materials such as heat, addition of a catalyst or the like. In treating the surface of the pulp board the material will usually penetrate into the depth of the board to some degree depending on the material used and the manner in which the material is applied. It is important in accordance with the present invention that the surface treatments leave some substantially untreated wood pulp fibers in the pulp board. Generally the surface treatments will not extend more than 10 to 30 percent of the depth of the batt.

In a preferred embodiment of the present invention opposite surfaces of wood pulp board are treated with the two materials. Each material is allowed to penetrate from about 10 to 30 percent of the depth of the board so that from about 40 to 80 percent of the thickness of the board in the center of the board is left untreated.

The treated pulp board is ground by standard grinding mechanisms to separate the pulp board into individualized wood pulp fibers. The individualized fibers are deposited on a member which is usually permeable to collect the fibers and allow the air to pass through. On collecting the fibers, depending on the materials used to initially treat the pulp board, the materials may react as the fibers are being collected to form the stabilized batt or the fibers may be collected and the batt further treated such as by heating or contacting with a gaseous catalyst or the like to react the materials and stabilize the batt and produce a uniform, resilient, stabilized, lightweight, fluffy batt of wood pulp fibers.

FURTHER DESCRIPTION OF THE INVENTION

Figures 2, 4:
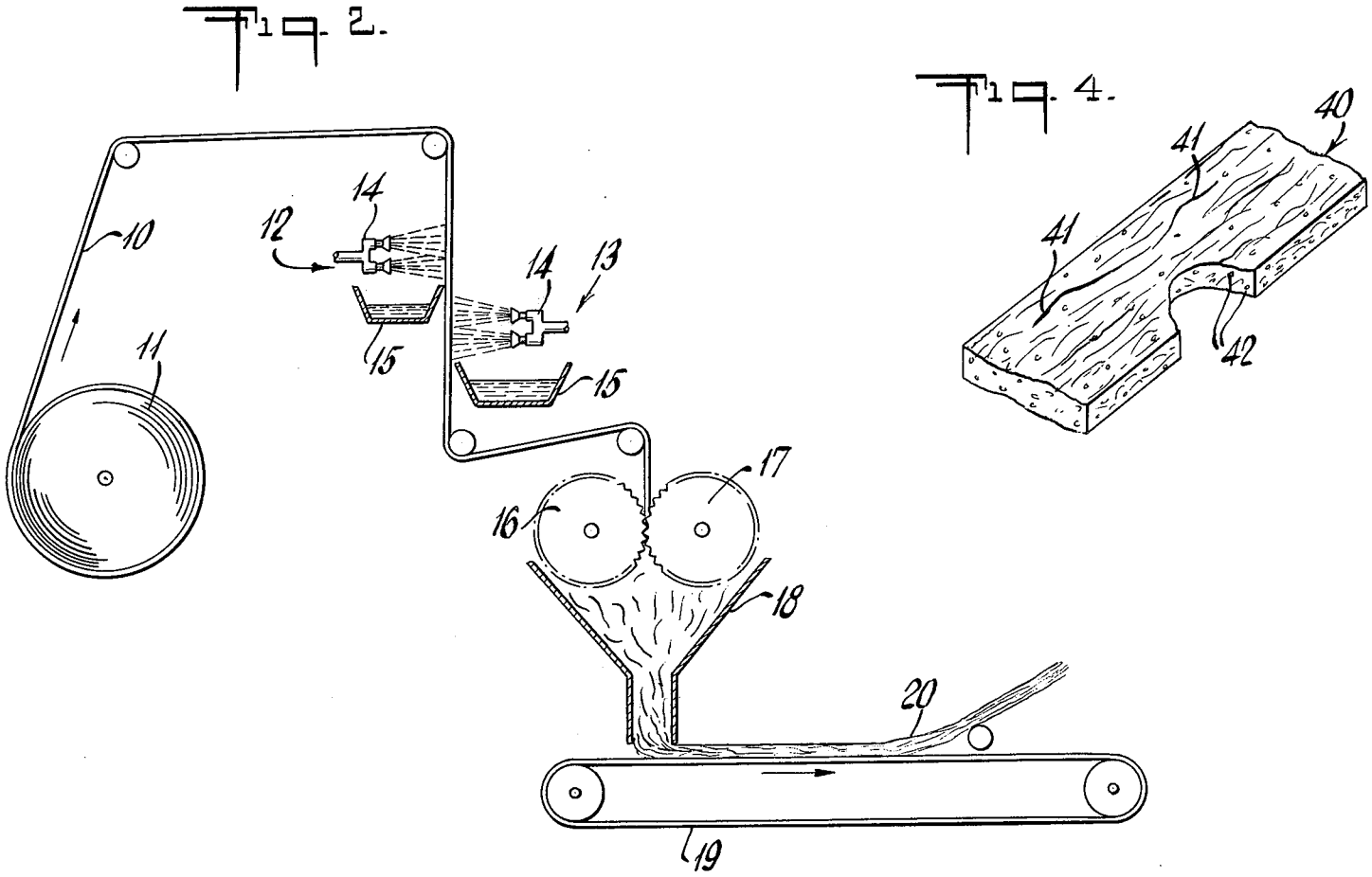
Figure 5:
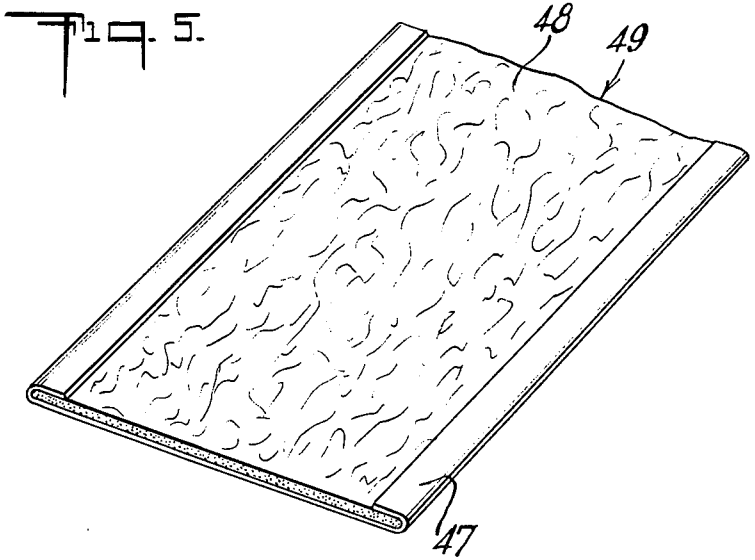
Figure 3:
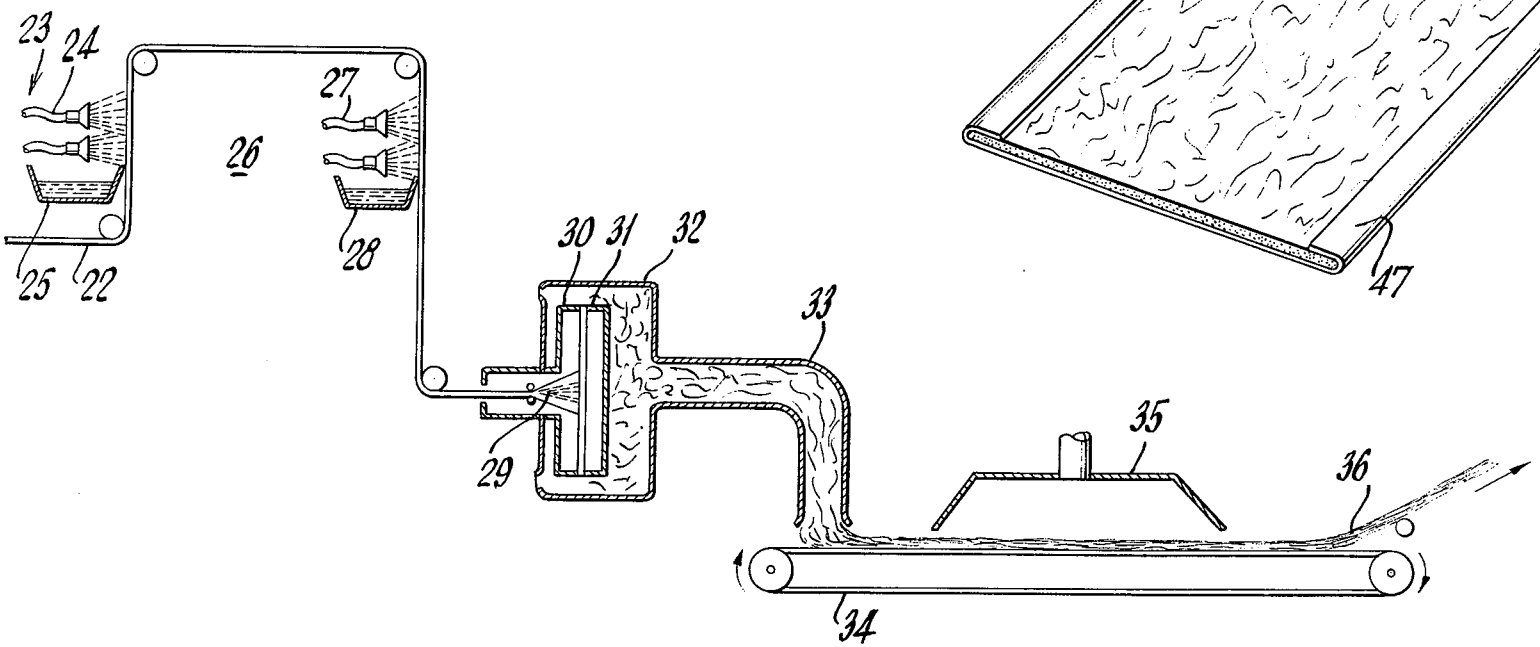

The invention will be more fully described in conjunction with the accompanying drawings wherein:

FIG. 1 is a flow-sheet showing the various steps for carrying out the method of the present invention, FIG. 2 is a schematic drawing of one method and apparatus for carrying out the present invention, FIG. 3 is a schematic drawing of another embodiment of method and apparatus for carrying out the present invention, FIG. 4 is a perspective view of the new stabilized, fluffy wood pulp batt of the present invention, and FIG. 5 is a perspective view of a diaper incorporating the new stabilized, fluffy wood pulp batt of the present invention.

Referring to the drawings in FIG. 1 there is shown a process flow-sheet for carrying out the method of the present invention. The first step in our new process (Box 1) is to apply a material to a first surface of pulp board. The material may be applied by spraying or knife-coating or similar techniques which substantially apply the material only to the surface.

The second step in my new process (Box 2) is to apply a second material to a second surface of pulp board and again this may be applied by spraying, coating or other well-known techniques.

It is critical to the present invention that the two materials not penetrate throughout the entire depth of the pulp board but there be a portion of the pulp board which remains untreated by either of the materials so that there are still untreated wood pulp fibers for carrying out the process.

The materials applied to the surfaces are materials that will react with each other and the reaction may occur merely on contact of the two materials or on contact for a period of time or the reaction may require some further treatment such as heating or the addition of a catalyst.

Examples of materials that can be used in accordance with the present invention are the epoxy resins which can be applied to one surface of the pulp board and a catalyst or hardening agent for the epoxy resin applied to the second surface of pulp board. When the treated pulp board is ground to individualize the fibers and distribute the epoxy resin and hardening agent throughout the individualized fibers and the fibers collected, depending on the hardening agents and epoxy resins used they may immediately react upon contact and start to cure to form an epoxy adhesive, or the fibers may be collected and the batt heated to cause the reaction or speed up the reaction and cure the epoxy.

Another class of materials that may be used in accordance with the present invention are the urethanes; for example, a polyether or polyester may be applied to one surface of the wood pulp board and a diisocyanate applied to the opposite surface of the pulp board. Upon grinding the pulp board and individualizing fibers the two materials can be reacted to form a polyurethane in situ to stabilize the collected wood pulp fibers. A modification of this technique would be to spray water or moisture at some point after the fibers have been individualized to foam the polyurethane in situ and allow the foamed polyurethane to stabilize the wood pulp fiber batt.

Another modification of the method of the present invention is to apply a polymerizable polyester resin to one surface of the wood pulp board and a peroxide catalyst such as methyl ethyl ketone peroxide to the opposite surface of the pulp board. When the pulp board is ground and the fibers individualized the catalyst polymerizes the polyester in situ and adhere fibers together to stabilize the fluffy batt as it is collected. If desired the batt may be heated to aid the curing reaction. One skilled in the art can, of course, think of other combinations of reactive materials which may be applied to the opposite surfaces of the pulp board and which will either react upon contact or caused to react by some further treatment such as heating, etc.

Inorganic materials may even be used in accordance with my new process; for example, a solution of calcium chloride may be applied to one surface and a solution of sodium silicate applied to the opposite surface of the pulp board. The treated pulp board is ground and in the individualizing and grinding step the calcium chloride and sodium silicate contact each other and react to form calcium silicate, an insoluble cement, to stabilize the fluffy wood pulp batt.

After the pulp board is treated with the reactive materials it may be desirable to remove the carriers for these materials before grinding (Box 3). For example, if the materials are applied from aqueous solutions the pulp board may be dried to remove the water. The dried pulp board is ground (Box 4) to comminute the board and individualize fibers and form an air slurry of wood pulp fibers. Some of the fibers in the air slurry have been treated with one material while other fibers have been treated with the second material which will react with the first material and yet other fibers are untreated. The three differently treated fibers uniformly distribute in the air slurry and are collected (Box 5) on a permeable screen which allows the air to pass through the screen and collects the fibers in the form of a fluffy batt.

As previously mentioned depending upon the reactive materials used the materials may immediately start their reaction upon contact with each other and as they are being collected in the batt (Box 6*a*) or the batt may be further treated (Box 6*b*) to either initiate the reaction or speed up a reaction already started. Once the reaction has been completed a uniformly stabilized lightweight fluffy batt of wood pulp fibers is produced (Box 7).

The properties of the final product will depend to a large extent on the type and amount of reactive materials used. In all instances the fluffy batt has a very low density and is lightweight. The fluffy batt is lofty and unexpectedly quite resilient in that the adhesive or stabilizing reactants are uniformly distributed throughout the depth of the batt. Once the fluffy batt is produced no liquid or water need be applied to the batt to stabilize it. Liquid, merely by its weight and capillary forces will tend to compress the batt and make it lose its loft and softness. If desired other materials such as textile fibers, etc. may be incorporated in the batt either as layers applied to the surfaces of the batt or as individual fibers added to the collecting means. Our new process allows for the use of adhesive for which there was no prior method of incorporating them in fluffy wood pulp batts.

In FIG. 2 of the drawings there is a schematic showing of one form of apparatus for carrying out the method of the present invention. Pulp board 10 is unwound from a supply roll 11 and passed between two spray stations 12 and 13. The first spray station 12 sprays material on one surface of the pulp board while the second spray station 13 sprays a second material on the opposite surface. Each station comprises spraying heads 14 and a reservoir 15 for collecting excess material. If desired, the treated pulp board may be heated or dried to drive off the carrier for the materials. The treated pulp board is passed to a grinding mechanism comprising a pair of counter-rotating toothed rolls 16 and 17. The toothed rolls comminute the pulp board into substantially individualized fibers and uniformly distributes the fibers into a directing funnel 18. The fibers are directed to a collecting means 19 which in this instance is a permeable screen which allows the air to pass through the screen and collects the fibers in the form of a batt 20 on the screen. The fibrous batt is removed from the screen and either wound up for further conversion or fed directly to a converting machine.

In FIG. 3 there is shown another form of apparatus for carrying out the method of the present invention. Pulp board 22 is fed to a first spray station 23 comprising spray nozzles 24 and a reservoir 25 for collecting excess sprayed material. A second spray station 26 also comprising spray nozzles 27 and a reservoir 28 is set in tandem with the first station to spray the opposite surface of the pulp board. The treated pulp board passes to a Bauer mill where the board is chopped into small squares 29 and the squares passed into the center of a pair of counter-rotating discs 30 and 31. The individualized comminuted wood pulp fibers are ejected from the periphery of the discs into a housing 32. The individualized fibers with the different types of treated fibers uniformly distributed throughout are passed through a conveying means 33 and collected on a permeable conveyor 34 in the form of a batt of fluffy wood pulp fibers. The batt passes through an oven 35 to cause or speed up the reaction between the two materials used and the batt 36 removed from the conveyor for further processing.

The wood pulp board used in accordance with the present invention may be any of the standard pulp boards such as Natchez pulp board, Alpha M pulp board, or the like and may be made from softwood or hardwood pulps. The boards are generally highly compacted and may vary in width from a couple of inches up to 100 inches or more and in thickness from one thirty-second of an inch up to as much as one-half inch or more. The pulp boards usually have a moisture content of 5 to 10 percent prior to being ground. After the pulp boards are treated they are ground by any of the well-known grinding mechanisms used for comminuting pulp board and individualizing the fibers such as a pair of counter-rotating, toothed rolls, Bauer mill, Fitz mill, hammer mill or the like.

In FIG. 4 there is shown a lightweight fluffy wood pulp batt 40 of the present invention wherein a portion of the batt has been cut away to show the thickness of the fluffy batt. The batt comprises wood pulp fibers 41 and uniformly distributed throughout the depth of the batt is the reacted material 42 which serves to stabilize the batt.

The batt may be used by itself as an absorbant dressing, sanitary napkin or the like or it may be laminated with other materials such as depicted in FIG. 5. In FIG. 5 thermoplastic film 47 is applied to one surface of the pulp batt 48 to form a disposable diaper 49. If desired a lightweight paper or nonwoven fabric may be applied to the other surface of the batt.

Having thus generally described the invention reference will now be made to the accompanying examples illustrating specific embodiments only.

EXAMPLE I

The starting pulp board used in this Example is a Natchez wood pulp board approximately 10 inches wide, one thirty-second of an inch thick and having a density of about 0.55 grams per cubic centimeter. A diluted epoxy resin sold by H. B. Fuller Canada Ltd. under the trademark FAYMOR 731–A and containing 50 percent solids dissolved in toluene is sprayed onto one surface of the pulp board. About 25 percent by weight of the board of epoxy is applied to the surface of the batt. The resin penetrates to about 25 percent of the thickness of the batt. The opposite side of the pulp board is sprayed with an amino hardening agent for the epoxy. The hardening agent used is a 50 percent toluene dispersion sold by H. B. Fuller Canada Ltd. under the trademark FAYMOR 731–B. Approximately 25 percent by weight of the board of the hardening agent is applied to this surface of the batt. The treated pulp board is ground in a hammer mill to comminuute and individualize the wood pulp fibers and uniformly distribute fibers coated with the epoxy resin, fibers coated with the amino hardening agent and uncoated fibers uniformly in an air slurry. The fibers are collected on a permeable screen in the form of a batt of wood pulp fibers having uniformly distributed throughout the batt the epoxy resin and hardening reagent. The batt has a density as collected of about 0.02 grams per cubic centimeter. The hardening reaction of the epoxy takes place at room temperature to stabilize the fluffy lightweight batt.

EXAMPLE II

A hardwood pulp board in the form of a highly pressed pulp board about 5 inches wide and one-eighth inch thick has applied to one surface an aqueous solution of calcium chloride. The solution is allowed to penetrate to about 25 percent of the thickness of the pulp board. The opposite surface of the pulp board is sprayed with a solution of sodium silicate again so that it penetrates only to about 25 percent of the depth of the pulp board. The pulp board is dried by passing it through an oven to drive off the water to a selected moisture content. The dried pulp board is ground by a pair of center-rotating toothed rolls to individualize the fibers and uniformly distribute untreated fibers from the center of the pulp board throughout the air slurry along with fibers coated with calcium chloride and fibers coated with sodium silicate. The fibers are collected on a conveyor and the calcium chloride and sodium silicate contact each other. The fluffy batt is exposed to steam to form in situ an insoluble, inorganic calcium silicate cement to stabilize the fluffy batt of wood pulp fibers.

EXAMPLE III

Alpha M wood pulp board approximately 10 inches wide and one thirty-second inch thick is sprayed on one surface with a dilute polyester casting resin. The resin used is sold by the Ciba-Geigy Co. under the trademark Ren. About 40 percent by weight of the batt of resin is added to the batt so that it penetrates the thickness of the pulp board less than 25 percent. The opposite surface of the pulp board is sprayed with a methyl ethyl ketone peroxide catalyst for the polyester resin. The treated pulp board is ground in a Fitz mill to individualize the fibers and uniformly distribute the polyester resin and catalyst throughout the fibers. Upon collecting the individualized fibers the polyester resin and catalyst react and stabilize the fibers as collected in the form of a fluffy batt of lightweight fibers.

EXAMPLE IV

A hardwood pulp board in the form of a highly pressed board about 5 inches wide and one-eighth inch thick and having a density of 0.55 grams per cubic centimeter has applied to one surface a polyester material in the form of adipic acid-diethylene glycol. A toluene diisocyanate is sprayed on the opposite surface. The treated pulp board is ground in a hammer mill to individualize the fibers and uniformly distribute the diisocyanate and polyester throughout the fibers. The fibers are collected on a permeable screen in the form of a light fluffy batt and the batt heated in the presence of moisture to react the polyester and the diisocyanate and form a polyurethane. The moisture foams the polyurethane in place to form a very lofty stabilized batt of wood pulp fibers stabilized with a polyurethane foam.

It will be understood by those skilled in the art that variations and modifications of the specific embodiments described above may be employed without departing from the scope of the invention as defined in the appended claims.

What is claimed is:

1. A method of manufacturing stabilized, lightweight, fluffy uniform batts of wood pulp fibers comprising: treating a first surface of wood pulp board with a first material, treating a second surface of wood pulp board with a second material capable of reacting with said first material, said surface treatments leaving from 40 percent to 80 percent untreated wood pulp fibers in the pulp board, said surface treatments applied in amounts sufficient to stabilize said batt of fibers upon the reaction of said first and second materials, grinding the treated wood pulp board to individualize the fibers therein and place the reactive materials in contact with each other, reacting said materials and collecting the individualized fibers in the form of a uniformly stabilized, lightweight, fluffy batt of said fibers.

2. A method according to claim 1 wherein the first material and the second material react with each other upon contact with each other.

3. A method according to claim 1 wherein the collected individualized wood pulp fibers having a first material and second material thereon are further treated to cause the first and second materials to react with each other.

4. A method according to claim 1 wherein the first material and second material are applied to opposite surfaces of wood pulp board.

5. A method according to claim 1 wherein the treated pulp board is dried prior to being ground to form individualized fibers.

6. A method according to claim 3 wherein the lightweight, fluffy batt is heated to a temperature above room temperature for a period of time to cause the first material and second material to react with each other.

7. A method according to claim 3 wherein the treated pulp board is dried before it is ground and the lightweight fluffy batt is heated to a temperature above room temperature to cause the first material and the second material to react with each other.

8. A method according to claim 1 wherein the first material is a liquid epoxy resin and the second material is an amine hardening agent for said epoxy resin.

9. A method according to claim 1 wherein the first material is calcium chloride and the second material is sodium silicate.

10. A method according to claim 1 wherein the first material is a diisocyanate and the second material is a polyester resin in which will react with each other to form a polyurethane.

11. A method according to claim 10 wherein the fluffy batt is sprayed with water after the grinding step and the said sprayed batt is dried in the presence of the water to foam the polyester and diisocyanate materials and form a polyurethane foam.

12. A method according to claim 1 wherein the first material is a polyester resin and the second material is a material capable of catalyzing the reaction of the first material for polymerizing the polyester resin.

* * * * *

UNITED STATES PATENT AND TRADEMARK OFFICE

CERTIFICATE OF CORRECTION

PATENT NO. : 3,950,218

DATED : April 13,1976

INVENTOR(S) : Yvon George Levesque

It is certified that error appears in the above-identified patent and that said Letters Patent are hereby corrected as shown below:

In Column 1, line 42, "for" should read --- of ---.

In Column 6, line 6, "comminuute" should read --- comminute ---.

In Column 6, line 31, "center" should read --- counter ---.

In Column 8, line 24, "resin in which" should read --- resin which ---.

In Column 8, line 28, "and the said" should read --- and said ---.

Signed and Sealed this

Sixteenth Day of November 1976

[SEAL]

*Attest:*

RUTH C. MASON
*Attesting Officer*

C. MARSHALL DANN
*Commissioner of Patents and Trademarks*